US010757508B2

(12) United States Patent
López Castillo

(10) Patent No.: US 10,757,508 B2
(45) Date of Patent: Aug. 25, 2020

(54) MAGNETIC TERMINAL CONNECTION FOR LOUDSPEAKERS

(71) Applicant: Tymphany Acoustic Technology (Huizhou) Co., Ltd., Huizhou, Guangdong Province (CN)

(72) Inventor: Jorge Alejandro López Castillo, Huizhou (CN)

(73) Assignee: TYMPHANY ACOUSTIC TECHNOLOGY (HUIZHOU) CO., LTD., Huizhou County, Guangdong Province (CN)

( * ) Notice: Subject to any disclaimer, the term of this patent is extended or adjusted under 35 U.S.C. 154(b) by 0 days.

(21) Appl. No.: 16/447,177

(22) Filed: Jun. 20, 2019

(65) Prior Publication Data

US 2019/0394572 A1 Dec. 26, 2019

(30) Foreign Application Priority Data

Jun. 20, 2018 (CN) ..... 2018 1 0633091

(51) Int. Cl.

| | |
|---|---|
| ***H04R 9/06*** | (2006.01) |
| ***H01R 13/22*** | (2006.01) |
| ***H01R 13/62*** | (2006.01) |
| ***H04R 1/06*** | (2006.01) |
| ***H04R 7/12*** | (2006.01) |
| ***H04R 9/02*** | (2006.01) |

(52) U.S. Cl.

CPC ..... *H04R 9/06* (2013.01); *H01R 13/22* (2013.01); *H01R 13/6205* (2013.01); *H04R 1/06* (2013.01); *H04R 7/12* (2013.01); *H04R 9/025* (2013.01); *H04R 2400/11* (2013.01)

(58) Field of Classification Search

CPC ... H04R 9/06; H04R 1/06; H04R 7/12; H04R 9/025; H04R 2400/11; H01R 13/22; H01R 13/6205

USPC ..... 381/409

See application file for complete search history.

(56) References Cited

U.S. PATENT DOCUMENTS

| | | | | | |
|---|---|---|---|---|---|
| 5,748,760 | A * | 5/1998 | Button | H04R 9/022 | 381/400 |
| 6,088,466 | A * | 7/2000 | Proni | H04R 9/02 | 381/397 |
| 6,222,929 | B1 * | 4/2001 | Kim | H04R 9/063 | 381/182 |
| 6,243,479 | B1 * | 6/2001 | Proni | H04R 9/022 | 381/397 |
| 6,774,510 | B1 * | 8/2004 | Moro | | 381/400 |

(Continued)

*Primary Examiner* — Sean H Nguyen

(74) *Attorney, Agent, or Firm* — Muncy, Geissler, Olds & Lowe, P.C.

(57) ABSTRACT

A speaker includes a terminal assembly. The speaker includes a magnetic circuit system and a voice coil, and two leads are extended into the voice coil. The terminal assembly is located at a shaft hollow portion of the magnetic circuit system, and the terminal assembly includes a first part, a second part, and two wires. The first part has a T shape, and a T-shaped top portion is attached to an upper plate of the speaker. An upper portion of the second part is correspondingly engaged with a lower portion of the first part. The two wires pass through the first part and the second part, and the two leads are respectively connected to the two wires on the top portion of the first part.

9 Claims, 8 Drawing Sheets

(56) References Cited

U.S. PATENT DOCUMENTS

| | | | | |
|---|---|---|---|---|
| 7,515,723 | B2 * | 4/2009 | Sagren | H04R 1/24 381/182 |
| 8,249,292 | B1 * | 8/2012 | James | H04R 9/06 381/412 |
| 9,084,056 | B2 * | 7/2015 | Flavignard | H04R 25/00 |
| 9,571,935 | B2 * | 2/2017 | Moro | H04R 9/022 |
| 10,219,061 | B2 * | 2/2019 | Cook | H04R 9/022 |
| 2002/0031239 | A1 * | 3/2002 | Kobayashi | G08B 6/00 381/412 |
| 2002/0033681 | A1 * | 3/2002 | Kobayashi | H04R 9/10 318/114 |
| 2002/0057820 | A1 * | 5/2002 | Kim | H04R 9/06 381/407 |
| 2006/0222199 | A1 * | 10/2006 | Abe | H04R 9/025 381/396 |
| 2007/0098209 | A1 * | 5/2007 | Setiabudi | H04R 9/06 381/412 |
| 2019/0313193 | A1 * | 10/2019 | Danovi | H04R 9/06 |

* cited by examiner

MAGNETIC TERMINAL CONNECTION FOR LOUDSPEAKERS

CROSS REFERENCE TO RELATED APPLICATIONS

This application claims priority under 35 U.S.C. § 119 to Chinese Patent Application No. CN 201810633091.0, which was filed on Jun. 20, 2018, and which is herein incorporated by reference.

BACKGROUND

Technical Field

This application relates to a terminal assembly of a speaker, and in particular, to a terminal assembly connected to a voice coil lead and a speaker having the terminal assembly.

Related Art

The sound production principle of a speaker is inputting a signal into a voice coil to generate a magnetic field and generating back and forth piston motion in a magnetic gap by mutual attraction and repulsion between magnetic poles, so that a diaphragm vibrates along with the back and forth piston motion of the voice coil and presses air to resonate. Auditory nerves spread over eardrums. Therefore, the vibration can be received, so that a sound is heard. Therefore, an electrical connection of the voice coil is very important.

Conventionally, the voice coil is soldered to terminals by using two leads, to be electrically connected. The terminal is usually fixed to a support frame and connected to connection lines (for a positive electrode and a negative electrode) of an input signal. However, the support frame is usually made of a plastic material because the support frame needs to be an insulator and be easily formed. Some support frames are not expected to be excessively thick, and even a support frame as thin as possible is preferred. Therefore, when the voice coil lead(s) is/are soldered to the terminal(s), a temperature (such as 430° C.) of a soldering tin head may cause the support frame deformed and thus hidden danger leaves.

As shown in FIG. 1, in a conventional speaker 200, a voice coil 11 of the speaker 200 is formed by winding around a voice coil bobbin 13, leads 16*a* and 16*b* are extended from the voice coil 11 and come to a support frame 14 from a location above the voice coil bobbin 13 and between a cone 12 and a damper 15, and then the leads 16*a* and 16*b* are soldered together with a connection line of an input signal (represented by a positive electrode and a negative electrode). However, a space between the cone 12 and the damper 15 is actually very narrow, and contact with other parts (especially a diaphragm 17) needs to be prevented by bending the leads 16*a* and 16*b*. If the leads 16*a* and 16*b* get in contact with other parts, buzzing occurs or even damage of other parts may be caused. In addition, the leads 16*a* and 16*b* need to be very carefully bent. If overbent, the leads 16*a* and 16*b* may be broken or functions of the leads 16*a* and 16*b* may degraded or even lost.

SUMMARY

In view of the above, certain exemplary embodiments of the present invention provide a terminal assembly, applicable to a speaker. The speaker includes a magnetic circuit system and a voice coil, and two leads are pulled out of the voice coil. The terminal assembly of this application is located at a shaft hollow portion of the magnetic circuit system, and the terminal assembly includes: a first part, a second part, and two wires. The first part has a T shape, and a T-shaped top portion is attached to an upper plate of the speaker. An upper portion of the second part is correspondingly engaged with a lower portion of the first part. The two wires pass through the first part and the second part, and the two leads are respectively connected to the two wires on the top portion of the first part.

In different embodiments, in another terminal assembly provided in this application, two leads pass through a first part, two wires pass through a second part, and the two leads are respectively connected to the two wires on a bottom portion of the first part.

In some embodiments, the terminal assembly further includes a metal ring. The upper portion of the second part includes a groove, and the groove corresponds to the metal ring, so that the metal ring is embedded into the groove. When the first part is combined with the second part, the first part and the second part may be caused to be tightly close to each other by means of a magnetic effect.

In some embodiments, the terminal assembly includes a first metal ring and a second metal ring. The lower portion of the first part includes a first groove, and the first groove corresponds to the first metal ring, so that the first metal ring is embedded into the first groove. The upper portion of the second part includes a second groove, and the second groove corresponds to the second metal ring, so that the second metal ring is embedded into the second groove. When the first part is combined with the second part, the first metal ring and the second metal ring get in contact with each other, and an attractive force is generated between the first metal ring and the second metal ring by means of a magnetic effect, so that the first part and the second part are tightly close to each other.

In some embodiments, the first part includes at least one air channel, the second part includes at least one air channel, and when the first part is combined with the second part, the air channels of the first part and the second part are in communication with each other.

In different embodiments, in the terminal assembly provided in this application, a metal ring is changed into two segments of metal ring sheets, the leads of the voice coil are respectively connected to upper edges of the two metal sheets, and then two wires are used to pass out of the second part respectively from lower edges of the two metal sheets. That is, in this embodiment, the two leads directly use the metal sheets as a conductive medium, and lengths of the two wires can be greatly reduced.

In addition, in different embodiments, in the terminal assembly provided in this application, either of two metal rings in the foregoing embodiments is changed into two segments of metal ring sheets, to enhance magnetic absorption.

Apart from the above, this application also provides a speaker, including a magnetic circuit system, a voice coil, and the foregoing terminal assembly. The magnetic circuit system has a shaft hollow portion, the magnetic circuit system includes an upper plate and a yoke, and a magnetic gap is provided between the upper plate and the yoke. The voice coil is located in the magnetic gap, and two leads are extended from the voice coil. The terminal assembly is located at the shaft hollow portion.

In conclusion, the terminal assembly and the speaker having the terminal assembly according to this application can improve assembly of the leads so as to improve efficiency of the speaker.

DETAILED DESCRIPTION

For ease of reading, in this specification, "up", "down", "left", and "right" that are shown in the figures intend to show reference relative portions of elements and are not used to limit this application.

Figure 1:
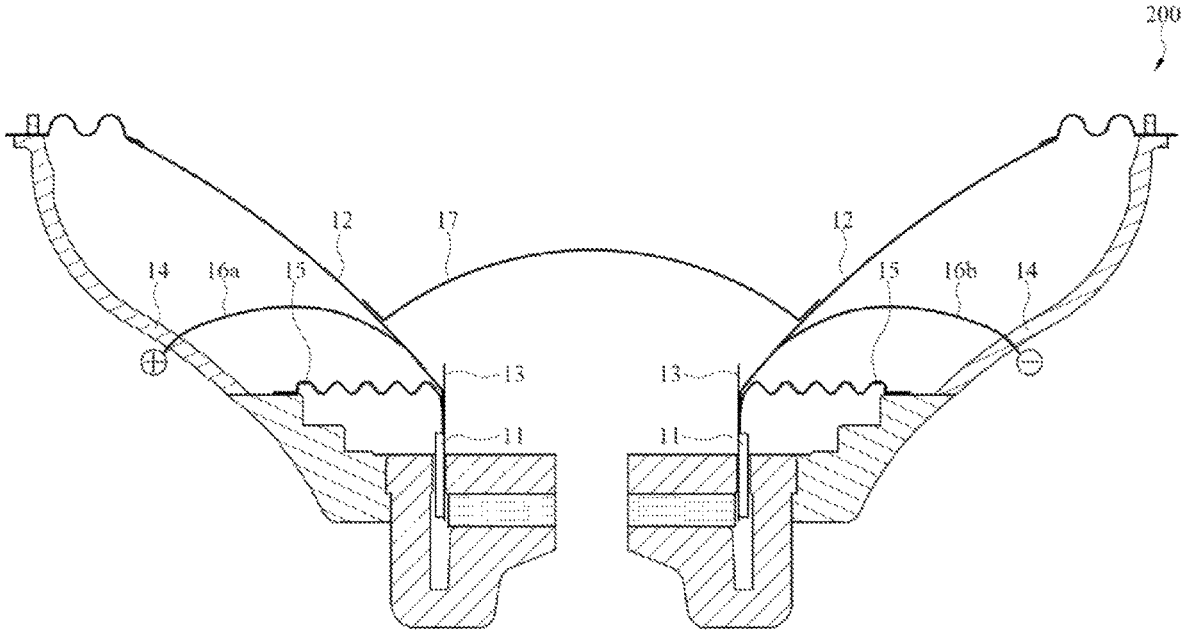
FIG. 1 (Prior Art)
FIG. 1 is a schematic cross-sectional view of a conventional speaker.
Figure 2:
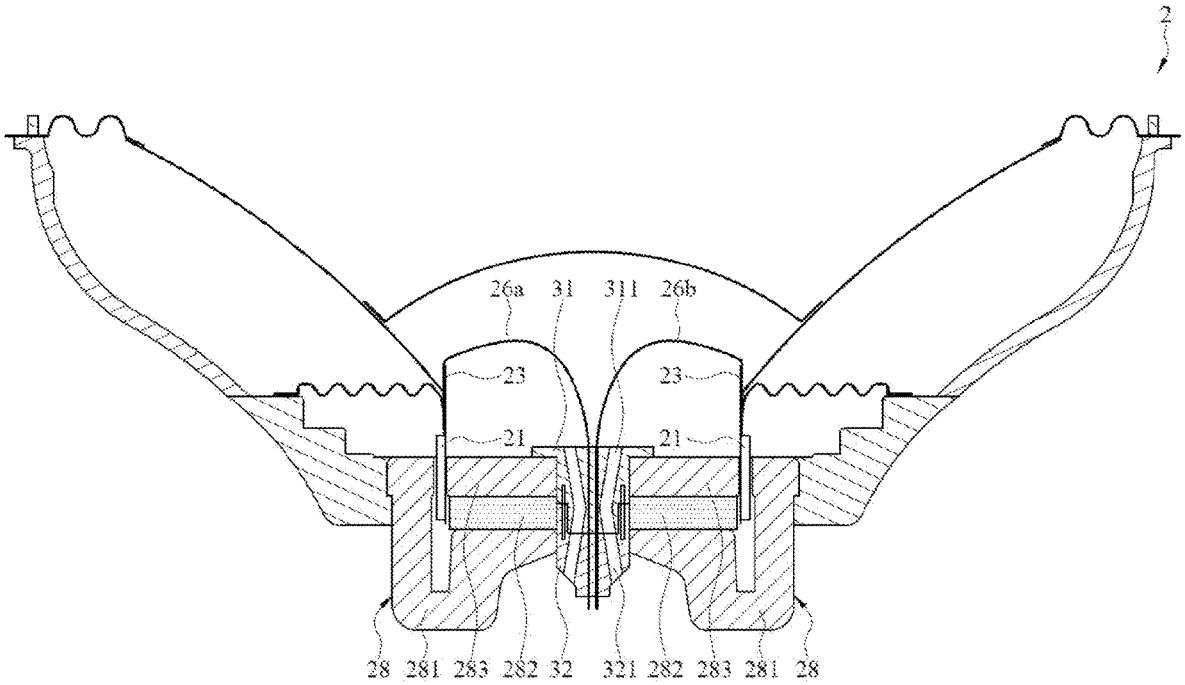
FIG. 2 is a schematic cross-sectional view of an embodiment of a speaker according to this application.

FIG. 2 is a schematic cross-sectional view of an embodiment of a speaker 2 according to this application. The speaker 2 includes a magnetic circuit system 28 and a voice coil 21, and two leads 26*a* and 26*b* are extended from the voice coil 21 above a voice coil bobbin 23. The magnetic circuit system 28 includes a yoke (for example, a U-shaped yoke) 281, a magnet 282, and an upper plate (or referred to as a washer) 283. A magnetic gap is provided between the upper plate 283 and the yoke 281, and the voice coil 21 is located in the magnetic gap.

Figure 3A:
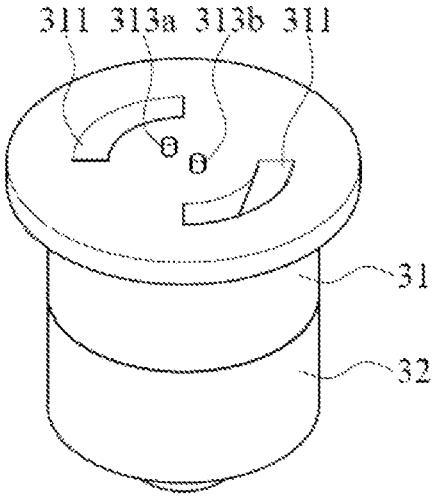
FIG. 3A is a schematic three-dimensional view of a terminal assembly according to this application.
Figure 3B:
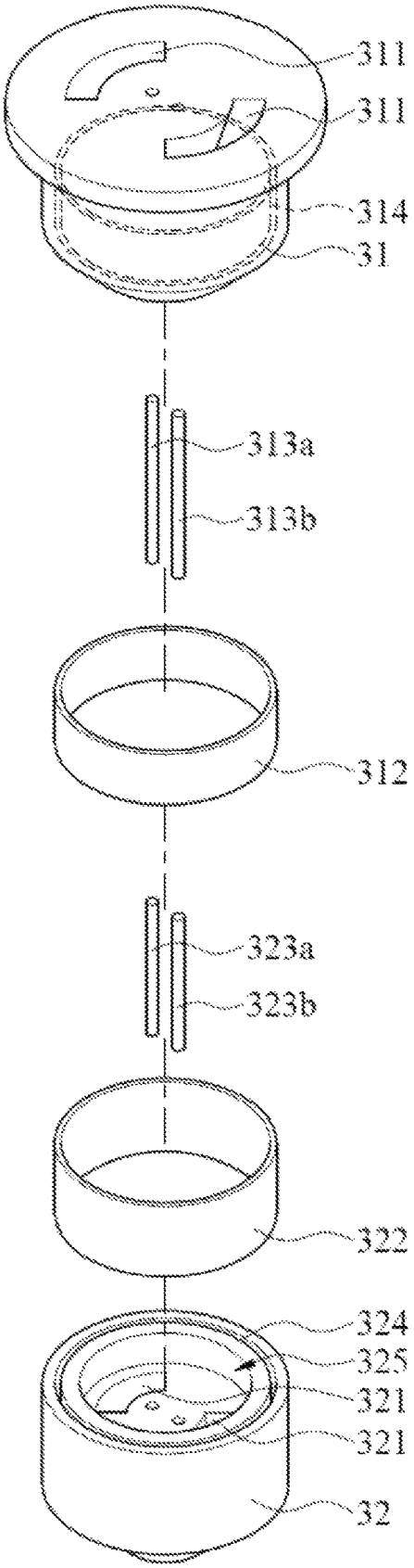
FIG. 3B is a schematic exploded view of the terminal assembly according to FIG. 3A.

Referring to both FIG. 3A and FIG. 3B, a terminal assembly of the embodiment of the invention includes: a first part 31, a second part 32, and two wires 313*a* and 313*b*. The terminal assembly is located at a shaft hollow portion of the magnetic circuit system 28 (as shown in FIG. 2). The first part 31 has a T shape, and a T-shaped top portion is attached to the upper plate 283 of the speaker 2. An upper portion of the second part 32 is correspondingly engaged with a lower portion of the first part 31. Various engagement shapes are possible and are not limited to concave-convex engagement shown in the figure. The two wires 313*a* and 313*b* pass through the first part 31 and the second part 32, and the two leads 26*a* and 26*b* are respectively connected to the two wires 313*a* and 313*b* on a top portion of the first part 31 through, for example, soldering or winding.

In different embodiments, two leads 26*a* and 26*b* first pass through a first part 31, and two wires 313*a* and 313*b* merely pass through a second part 32, the two leads 26*a* and 26*b* are respectively connected to the two wires 313*a* and 313*b* at a bottom portion of the first part 31 (not shown in the figure) through, for example, soldering or winding.

In some embodiments, as shown in FIG. 3B, the terminal assembly further includes a first metal ring 312 and a second metal ring 322. The lower portion of the first part 31 includes a first groove 314, and the first groove 314 corresponds to the first metal ring 312, so that the first metal ring 312 is embedded into the first groove 314. The upper portion of the second part 32 includes a second groove 324, and the second groove 324 corresponds to the second metal ring 322, so that the second metal ring 322 is embedded into the second groove 324.

Figure 4:
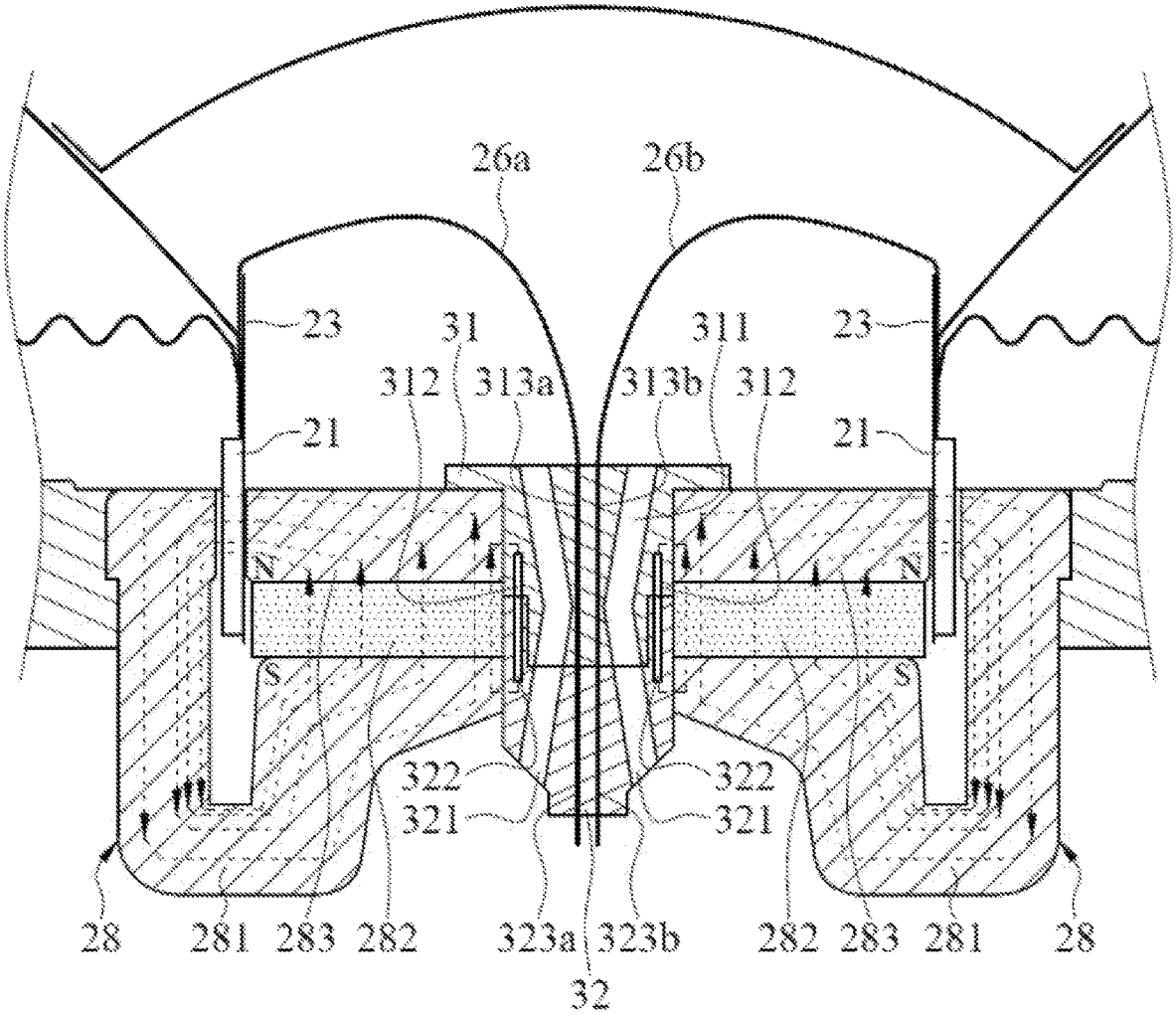
FIG. 4 is locally enlarged view of the speaker according to FIG. 2.

Referring to FIG. 4, when the first part 31 is combined with the second part 32, the first metal ring 312 and the second metal ring 322 are in contact with each other. When the magnetic circuit system 28 is operated, the first metal ring 312 and the second metal ring 322 that are close to the magnet 282 can guide a magnetic line of the magnet 282 from an N pole to an S pole, to form a magnetic attractive force. Therefore, a magnetic effect may be generated between the first metal ring 312 and the second metal ring 322, and the first metal ring 312 and the second metal ring 322 are attracted to each other, so that the first part 31 and the second part 32 are tightly close to each other. That is, the magnetic circuit system 28 is configured to contribute a magnetic field, which leads the first metal ring 312 and the second metal ring 322 to be magnetically drawn to each other. In other words, the first part 31 and the second part 32 are able to be contact one another and to be held tightly against each other through magnetic force because the first metal ring 312 and the second metal ring 322 are situated respectively in the grooves of the first part 31 and the second part 32.

In some embodiments, the terminal assembly may include only one metal ring (that is, the first metal ring 312 is omitted). Therefore, only the upper portion of the second part 32 includes a groove 324, and the metal ring is embedded into the groove 324. However, the metal ring (not shown in the figure) in this embodiment is higher (or larger) than the second metal ring in the two metal rings in the foregoing embodiment of the two metal rings. An upper edge of the metal ring is close to the upper plate 283, and a lower edge of the metal ring is close to the U-shaped yoke 281. In this way, the metal ring can also guide a magnetic line from the U-shaped yoke 281 to the upper plate (or washer) 283. In this embodiment, the T-shaped top portion of the first part 31 is first adhered to and fixed to the upper plate 283. When the first part 31 is combined with the second part 32, the first part 31 and the second part 32 may be caused to be tightly close to each other by magnetic attraction.

In some embodiments, the first part 31 includes at least one air channel 311, the second part 32 includes at least one air channel 321, and when the first part 31 is combined with the second part 32, the air channels 311 and 321 of the first part 31 and the second part 32 are in communication with each other. Therefore, ventilation and heat dissipation effects can be provided.

Figure 5A:
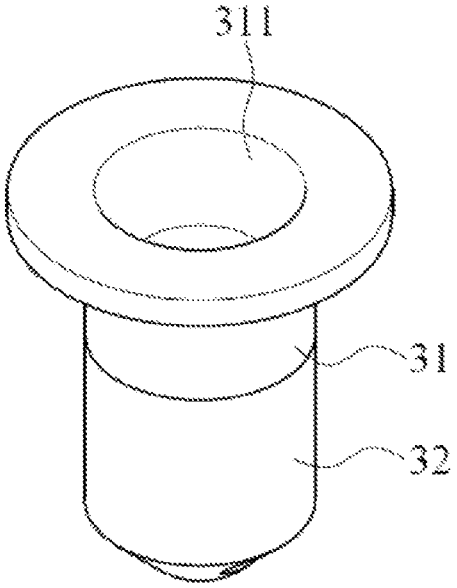
FIG. 5A is a schematic three-dimensional view of a terminal assembly according to another embodiment of this application.
Figure 5B:
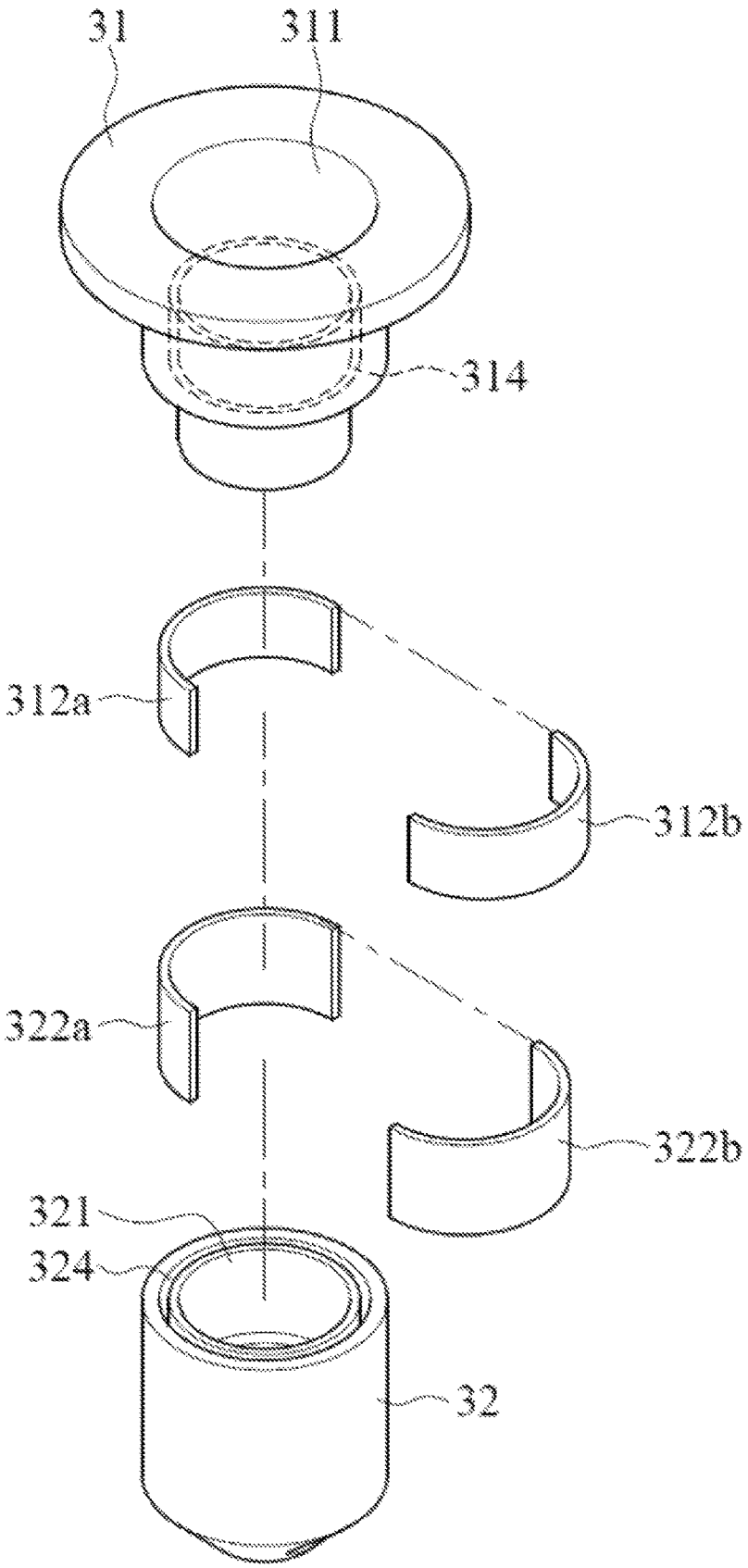
FIG. 5B is a schematic exploded view of the terminal assembly according to FIG. 5A.
Figure 6:
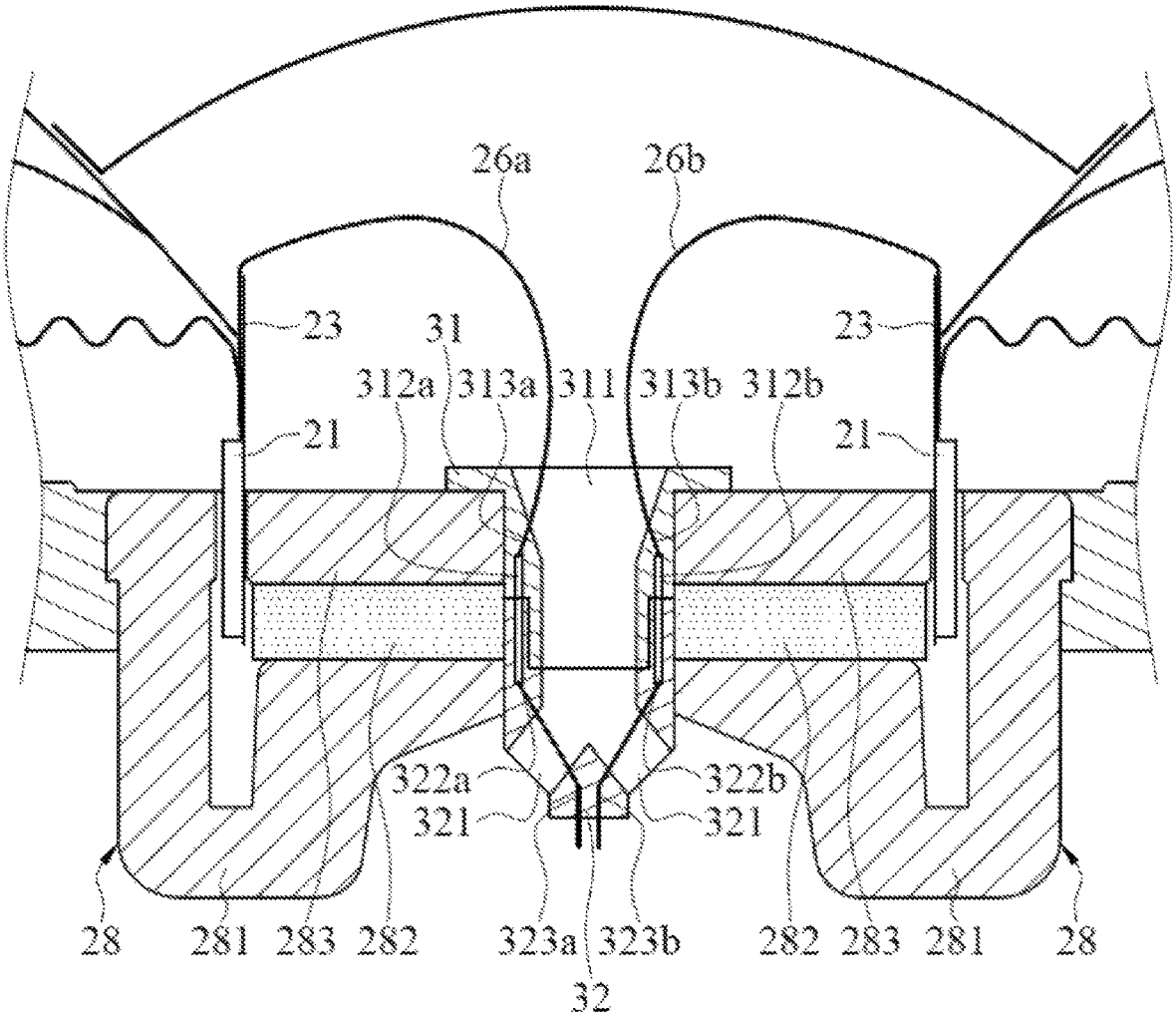
FIG. 6 is a schematic cross-sectional view of an embodiment of another speaker according to this application.

In different embodiments, referring to FIGS. 5A and 5B, in the terminal assembly provided in this application, two metal rings (312, 322) in the foregoing embodiments are respectively changed into two segments of metal ring sheets (that is, two first metal sheets 312*a* and 312*b* and two second metal sheets 322*a* and 322*b*). Referring to FIG. 6, the leads 26*a* and 26*b* of the voice coil 21 are respectively connected to upper edges of the two first metal sheets 312*a* and 312*b* (through, for example, soldering or winding), and the two wires 323*a* and 323*b* are used to connect to the two second metal sheets 322*a* and 322*b*, and then pass through out of the second part 32 from lower edges of two second metal sheets 322*a* and 322*b*. In this embodiment, the two leads 26*a* and 26*b* directly use the metal sheets as a conductive medium; not only a magnetic attractive force is reserved, but also lengths of the two wires can be greatly reduced.

Similarly, in the terminal assembly provided in this application, two groups of metal ring sheets ((312*a*, 312*b*, 322*a*, 322*b*) in the foregoing embodiments are changed into one group of metal ring sheets (322*a*, 322*b*). That is, first metal ring sheets 312*a* and 312*b* are omitted. The metal ring sheet (not shown in the figure) in this embodiment is higher than the second metal ring sheet in the two groups of metal ring sheets. Upper edges of the two metal ring sheets are close to the upper plate 283, and lower edges of the metal ring sheets are close to the U-shaped yoke. In this way, the metal ring sheets can also guide a magnetic line from the U-shaped yoke 281 to the upper plate (washer) 283. In this embodiment, the T-shaped top portion of the first part 31 is first adhered to and fixed to the upper plate 283. When the first part 31 is combined with the second part 32, the first part 31 and the second part 32 may be caused to be tightly close to each other by magnetic attraction.

Referring to FIG. 6, in different embodiments, the air channel 311 of the first part 31 and the air channel 321 of the second part 32 may have various variations.

The terminal assembly in the foregoing various embodiments of this application is also applicable to a speaker.

In short, the terminal assembly and the speaker having the terminal assembly according to this application can improve assembly of the leads so as to improve efficiency of the speaker.

Although this application is disclosed as above by using embodiments, the embodiments are not intended to limit this application. Any person skilled in the art can make some variations and modifications without departing from the spirit and scope of this application. Therefore, the protection scope of this application should be subject to the scope of appended claims.

What is claimed is:

1. A terminal assembly used for a speaker having two leads extended from a voice coil, wherein the terminal assembly is located at a shaft hollow portion of a magnetic circuit system, the terminal assembly comprising:

a first part having a T shape, wherein a top portion of the first part is configured to be attached to an upper plate of the speaker;

a second part, wherein an upper portion of the second part is correspondingly engaged with a lower portion of the first part; and two wires passing through the first part and the second part, wherein the two leads are respectively connected to the two wires on the top portion of the first part.

2. The terminal assembly according to claim 1, wherein the terminal assembly comprises a metal ring, wherein the upper portion of the second part comprises a groove corresponding to the metal ring such that the metal ring is embedded into the groove, and wherein, when the first part is combined with the second part, the first part and the second part are drawn to each other by magnetic attraction.

3. The terminal assembly according to claim 2, wherein the terminal assembly comprises a first metal ring, wherein the lower portion of the first part comprises a first groove corresponding to the first metal ring such that the first metal ring is embedded into the first groove, and wherein, when the first part is combined with the second part, the first metal ring and the metal ring contact with each other and a magnetic attraction is generated between the first metal ring and the metal ring.

4. A speaker, comprising:

a magnetic circuit system, having a shaft hollow portion, the magnetic circuit system comprising:

an upper plate;

a yoke; and a magnetic gap provided between the upper plate and the yoke;

a voice coil located in the magnetic gap, wherein two leads are extended from the voice coil; and the terminal assembly according to claim 1, wherein the terminal assembly is located at the shaft hollow portion.

5. A terminal assembly used for a speaker having two leads extended from a voice coil, wherein the terminal assembly is located at a shaft hollow portion of a magnetic circuit system, the terminal assembly comprising:

a first part having a T shape, wherein a top portion of the first part is configured to be attached to an upper plate of the speaker, and the two leads pass through the first part;

a second part, wherein an upper portion of the second part is correspondingly engaged with a lower portion of the first part; and two wires passing through the second part, wherein the two leads are respectively connected to the two wires at a bottom portion of the first part.

6. The terminal assembly according to claim 1, wherein the first part comprises at least one air channel, the second part comprises at least one air channel, and when the first part is combined with the second part, the air channels of the first part and the second part are in communication with each other.

7. A terminal assembly for a speaker, wherein the speaker comprises two leads extended from a voice coil, the terminal assembly being located at a shaft hollow portion of a magnetic circuit system, the terminal assembly comprising:

a first part having a T shape, wherein a top portion of the first part is configured to be attached to an upper plate of the speaker;

a second part, wherein an upper portion of the second part is correspondingly engaged with a lower portion of the first part;

two metal sheets, embedded into the upper portion of the second part, and the two leads are respectively connected to upper edges of the two metal sheets; and two wires passing through out of the second part respectively from lower edges of the two metal sheets.

8. The terminal assembly according to claim 7, wherein the first part comprises at least one air channel, the second part comprises at least one air channel, and when the first part is combined with the second part, the air channels of the first part and the second part are in communication with each other.

9. A terminal assembly for a speaker comprising two leads extended from a voice coil, the terminal assembly being located at a shaft hollow portion of a magnetic circuit system, the terminal assembly comprising:

a first part having a T shape, wherein a top portion of the first part is configured to be attached to an upper plate of the speaker;

a second part, wherein an upper portion of the second part is correspondingly engaged with a lower portion of the first part;

two first metal sheets embedded into the lower portion of the first part, wherein the two leads are respectively connected to upper edges of the two first metal sheets;

two second metal sheets embedded into the upper portion of the second part; and two wires passing out of the second part respectively from lower edges of the two second metal sheets, wherein when the first part is combined with the second part, the two first metal sheets and the two second metal sheets get in contact with each other, and a magnetic attraction is generated between the two first metal sheets and the two second metal sheets.

* * * * *